US010386152B1

(12) United States Patent
Huang

(10) Patent No.: US 10,386,152 B1
(45) Date of Patent: Aug. 20, 2019

(54) ADJUSTABLE WIDTH BOWSTRING SLED

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 16/191,649

(22) Filed: Nov. 15, 2018

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01); *F41B 5/123* (2013.01)

(58) Field of Classification Search
CPC ..... F41B 5/12; F41B 5/123
See application file for complete search history.

(56) References Cited

U.S. PATENT DOCUMENTS 5,243,956 A * 9/1993 Luehring ..... F41B 5/12 124/25
7,100,590 B2 * 9/2006 Chang ..... F41B 5/123 124/25
7,624,725 B1 * 12/2009 Choma ..... F41B 5/1469 124/25
9,285,182 B2 3/2016 Bednar et al.
10,295,298 B2 * 5/2019 Shaffer ..... F41B 5/148
2012/0037139 A1 * 2/2012 Barnett ..... F41B 5/1469 124/86

* cited by examiner

*Primary Examiner* — John A Ricci
(74) *Attorney, Agent, or Firm* — Donald J. Ersler

(57) ABSTRACT

An adjustable width bowstring sled preferably includes a first frame member, a second frame member, a first cross rod, a second cross rod, a thumb wheel, and two rollers. The first frame member includes a first rod base and a first line yoke. The second frame member includes a second rod base and a second line yoke. The thumb wheel is rotatably retained in the first rod base. An opposing end of the first cross rod is threadably retained in the second rod base. One end of the second cross rod is slidably retained in the second rod base. An opposing end of the second rod base is secured to the second rod base. The first roller is retained in the first line yoke. The second roller is retained in the second line yoke.

15 Claims, 5 Drawing Sheets

ADJUSTABLE WIDTH BOWSTRING SLED

BACKGROUND OF THE INVENTION

1. Field of the Invention

The present invention relates generally to archery and more specifically to an adjustable width bowstring sled, which allows opposing sides of a bowstring sled to be adjusted to contact opposing guide rails on a crossbow.

2. Discussion of the Prior Art

U.S. Pat. No. 9,285,182 to Bednar et al. discloses a connectable two piece bowstring engaging mechanism for crossbow. However, it appears that the prior art does not teach or suggest an adjustable width bowstring sled, which allows a width of a bowstring sled to be adjusted to contact opposing guide rails on a crossbow.

Accordingly, there is a clearly felt need in the art for an adjustable width bowstring sled, which allows a width of a bowstring sled to be adjusted to contact opposing guide rails on a crossbow.

SUMMARY OF THE INVENTION

The present invention provides an adjustable width bowstring sled, which allows a width of a bowstring sled to be adjusted to contact opposing guide rails on a crossbow. The adjustable width bowstring sled (adjustable sled) preferably includes a first frame member, a second frame member, a first cross rod, a second cross rod, a thumb wheel, and two rollers. The first frame member includes a first rod base and a first line yoke, which extends from a front of the first rod base. The second frame member includes a second rod base and a second line yoke, which extends from a front of the second rod base. The first rod base includes a first rod bore, a thumb wheel slot, a detent bore and a second rod bore. The first rod bore is sized to rotatably receive one end of the first cross rod. The thumb wheel slot provides clearance for the thumb wheel. The detent bore is sized to receive a compression spring and detent ball or any other suitable detent device. The second rod bore is sized to slidably receive one end of the second cross rod. A flat bearing surface is formed on one end of the first cross rod and a first threaded end is formed on an opposing end of the first cross rod.

The thumb wheel includes a round shape outer perimeter. A shaft hole is formed through a thickness of the thumb wheel to receive the opposing end of the first cross rod. A threaded hole is formed through an outer perimeter of the thumb wheel and intersects the shaft hole. A set screw or the like is threaded into the threaded hole to secure the thumb wheel on the one end of the first cross rod. A plurality of width holes are formed on one side of the thumb wheel to receive an end of the detent ball. The compression spring and detent ball prevent rotation of the thumb wheel, when seated in one of the plurality of width holes. The second rod base includes a first threaded hole and a second threaded hole. The first threaded hole is sized to threadably receive an opposing end of the first cross rod. The second threaded hole is sized to threadably receive an opposing end of the second cross rod.

An alterative design of the first cross rod includes a bolt; a set screw or the like; and a snap ring. A counterbore is formed in the first rod base to receive a head of the bolt. A threaded hole is formed through the second rod base to receive a threaded end of the bolt. A snap ring groove is formed in the bolt to receive a snap ring. The snap ring prevents axial movement of the bolt relative to the first rod base. The set screw is used to jam the threaded end of the bolt to prevent rotation thereof.

The first line yoke includes a pair of first retention projections. A first roller slot is formed between the pair of first retention projections and is sized to receive the first roller. The first roller is preferably rotatably retained with a first shoulder screw. A first counter bore is formed through one of the pair of first retention projections, and a first threaded hole is formed through the other one of the pair of first retention projections to retain the first shoulder screw. The second line yoke includes a pair of second retention projections. A second roller slot is formed between the pair of second retention projections and is sized to receive the second roller. The second roller is preferably rotatably retained with a second shoulder screw. A second counter bore is formed through one of the pair of second retention projections, and a second threaded hole is formed through the other one of the pair of second retention projections to retain the first shoulder screw. Alternatively, first and second shoulder screws may be replaced with first and second pins.

Accordingly, it is an object of the present invention to provide an adjustable width bowstring sled, which allows a width of a bowstring sled to be adjusted to contact opposing guide rails on a crossbow.

These and additional objects, advantages, features and benefits of the present invention will become apparent from the following specification.

DETAILED DESCRIPTION OF THE PREFERRED EMBODIMENTS

Figure 1:
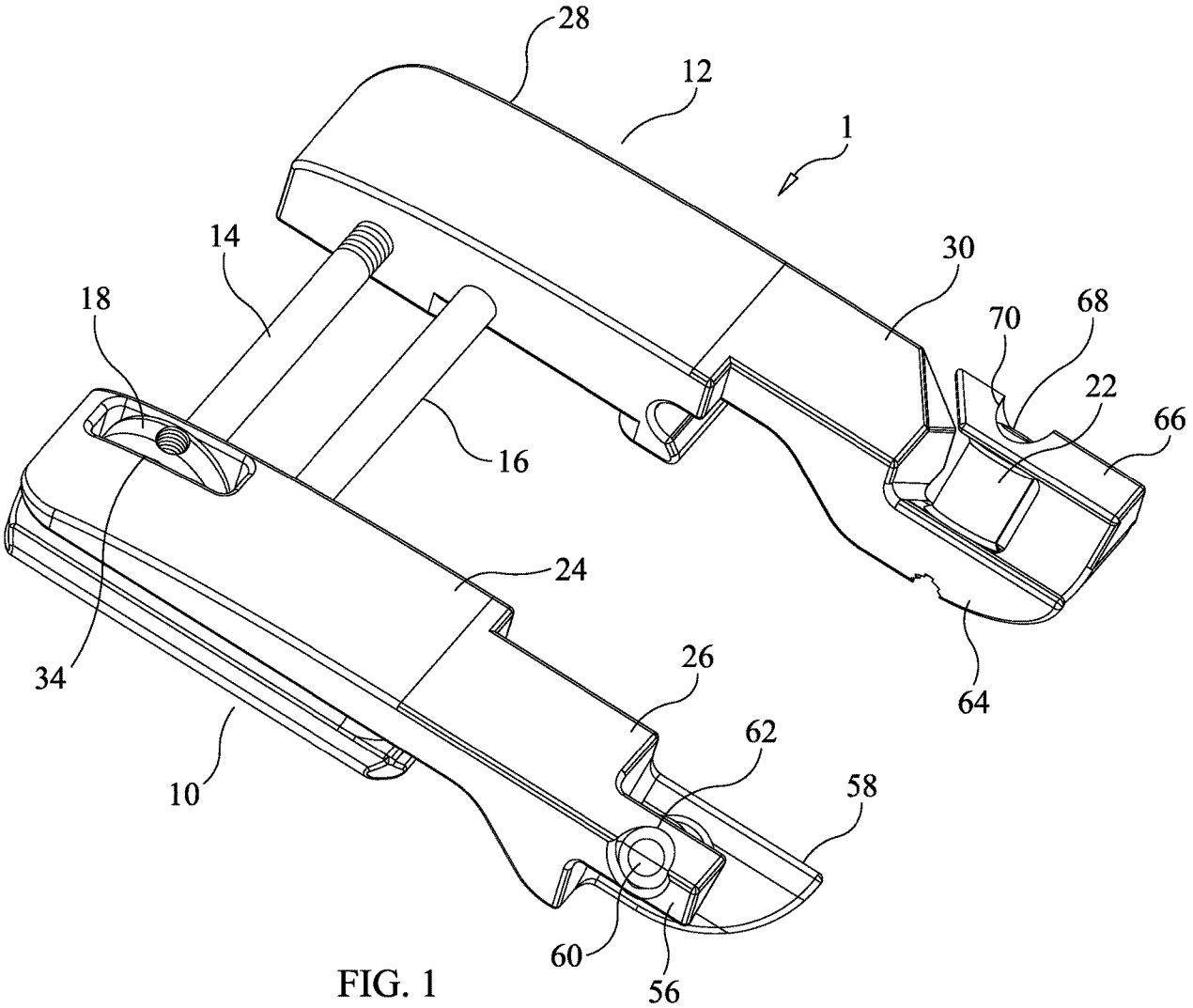
FIG. 1 is a perspective view of an adjustable width bowstring sled in accordance with the present invention.
Figure 2:
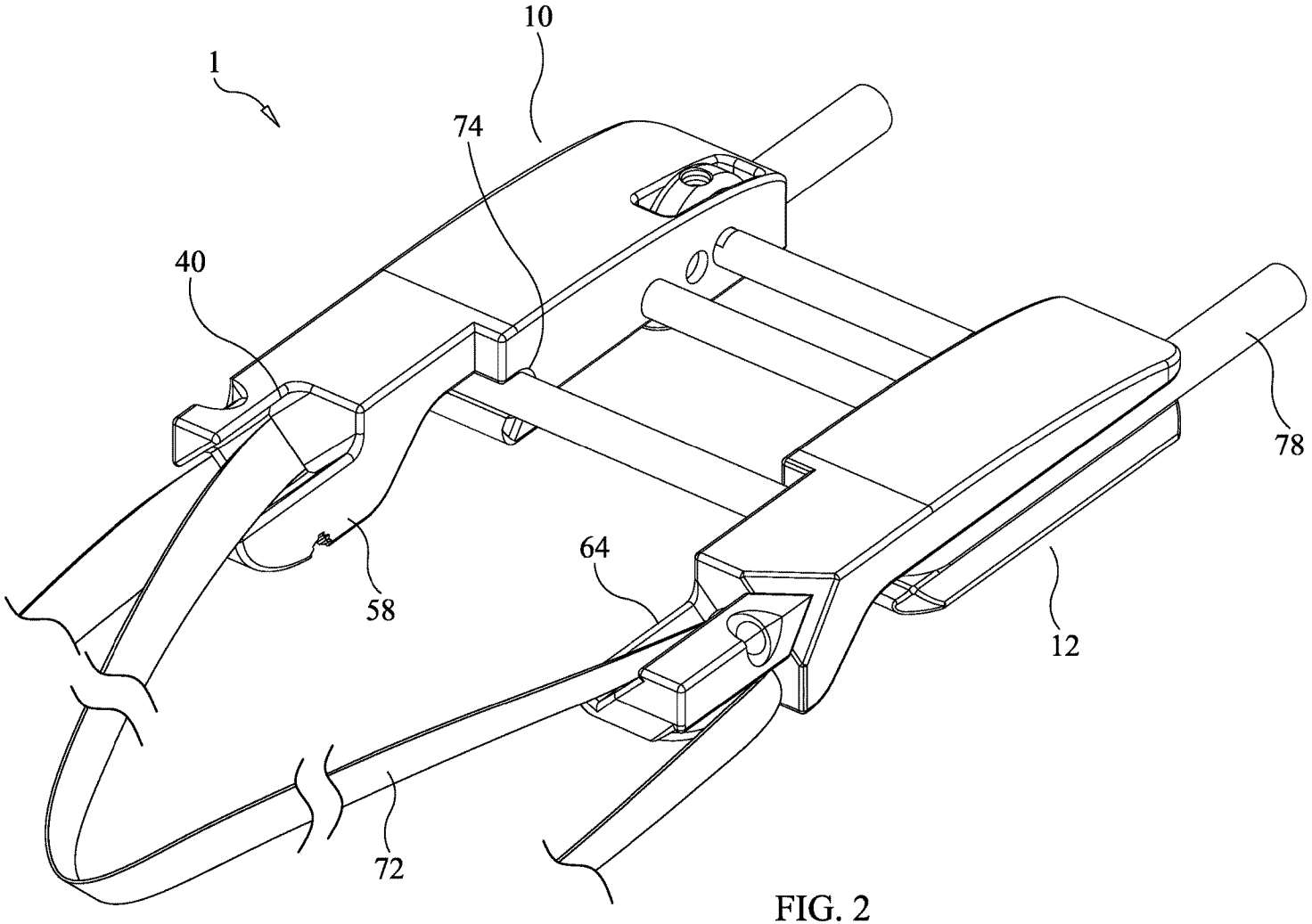
FIG. 2 is a perspective view of an adjustable width bowstring sled with a bowstring retained by first and second rod bases, and a reel ribbon retained by first and second line yokes in accordance with the present invention.
Figure 3:
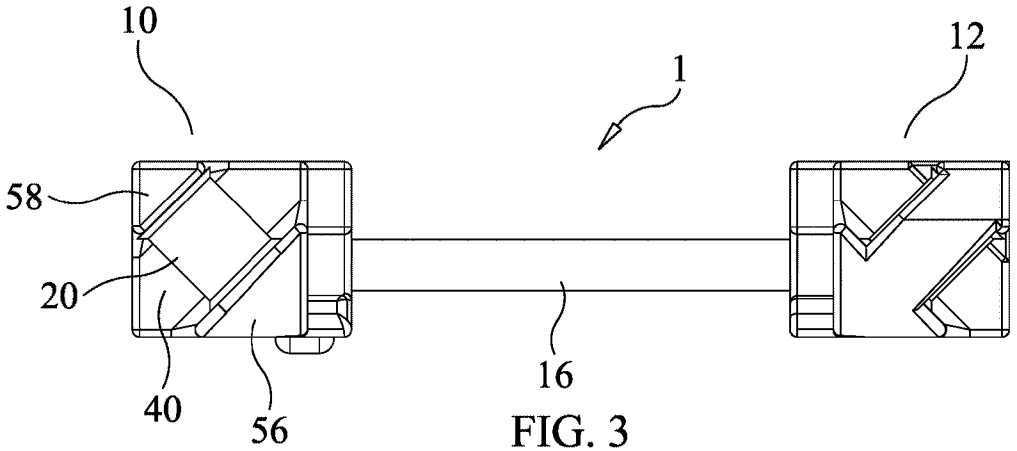
FIG. 3 is a front view of an adjustable width bowstring sled in accordance with the present invention.
Figure 4:
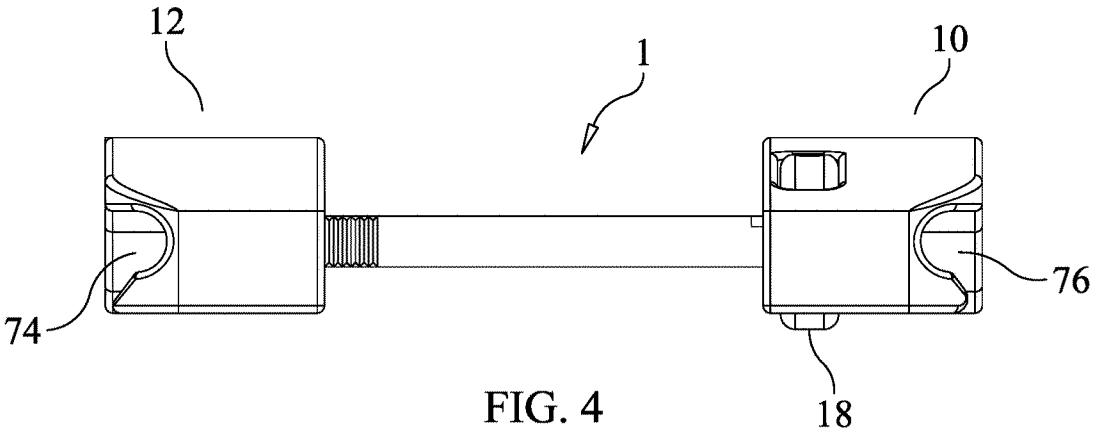
FIG. 4 is a rear view of an adjustable width bowstring sled in accordance with the present invention.
Figure 5:
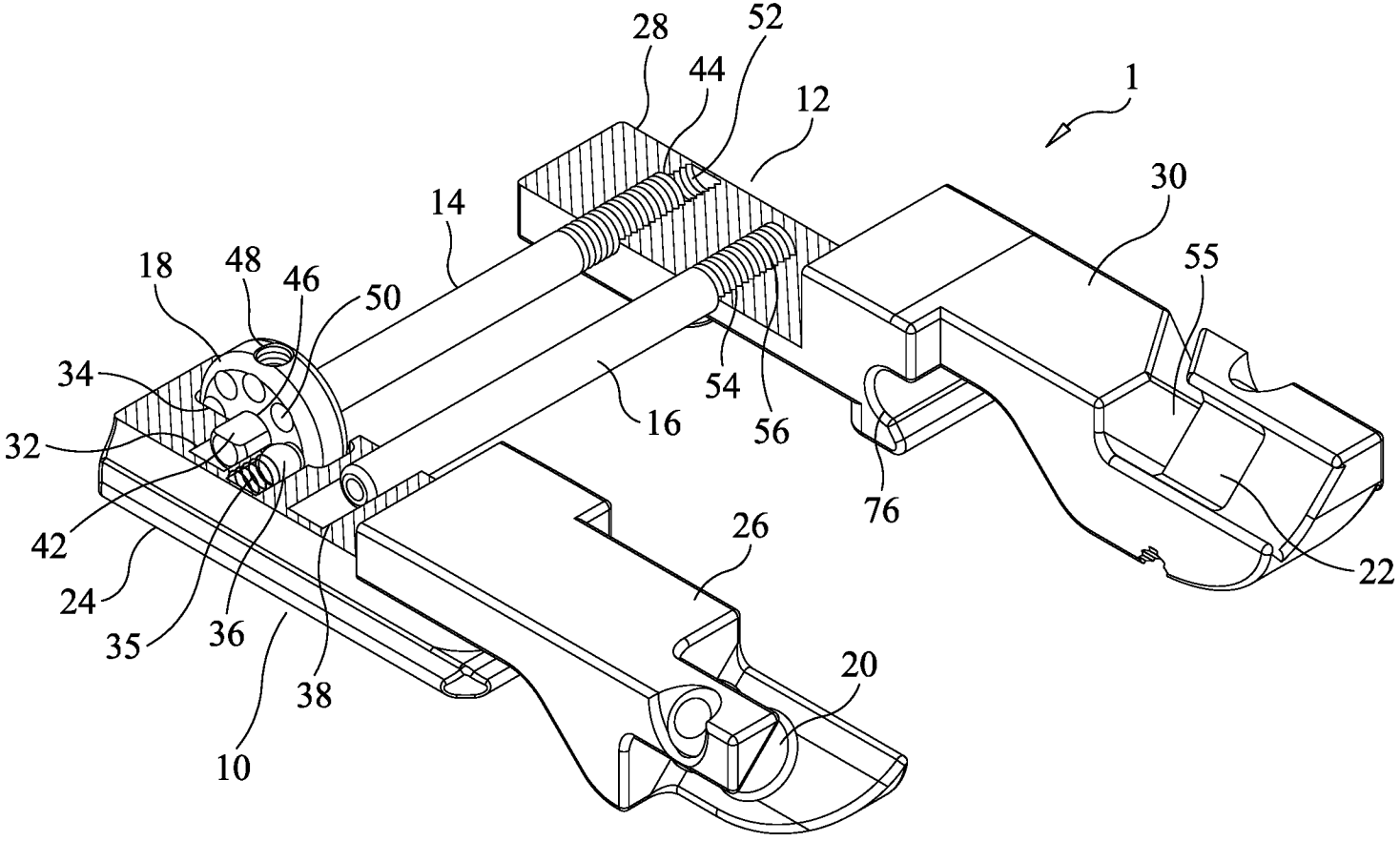
FIG. 5 is a perspective view of an adjustable width bowstring sled with a cut-away area, which reveals first and second cross rods in accordance with the present invention.

With reference now to the drawings, and particularly to FIG. 1, there is shown a perspective view of an adjustable sled 1. With reference to FIGS. 2-4, the adjustable sled 1 preferably includes a first frame member 10, a second frame member 12, a first cross rod 14, a second cross rod 16, a thumb wheel 18, and two rollers 20, 22. The first frame member 10 includes a first rod base 24 and a first line yoke 26, which extends from a front of the first rod base 24. The second frame member 12 includes a second rod base 28 and a second line yoke 30, which extends from a front of the second rod base 28. With reference to FIG. 5, the first rod base 24 includes a first rod bore 32, a thumb wheel slot 34, a detent bore 36 and a second rod bore 38. The first rod bore 32 is sized to slidably receive one end of the first cross rod 14. The thumb wheel slot 34 provides clearance for the thumb wheel 18. The detent bore 36 is sized to receive a compression spring 35 and a detent ball 37. The compression spring 35 and the detent ball 37 may be replaced with any suitable detent device. The second rod bore 38 is sized to slidably receive one end of the second cross rod 16. The first cross rod 14 includes the one end with a flat bearing surface 42 and an opposing end with a first threaded end 44.

The thumb wheel 18 includes an outer perimeter with a round shape. A shaft hole 46 is formed through a thickness of the thumb wheel 18 to receive the one end of the first cross rod 14. A threaded hole 48 is formed through an outer perimeter of the thumb wheel 18 and intersects the shaft hole 46. A set screw or the like is threaded into the threaded hole 48 to secure the thumb wheel 18 on the flat bearing surface 42 of the first cross rod 14. A plurality of width holes 50 are formed on one side of the thumb wheel 18 to receive the detent ball 37. The detent ball 37 prevents the thumb wheel 18 from rotating, when seated in one of the plurality of width holes 50. The second rod base 12 includes a first threaded hole 52 and second threaded hole 54. The first threaded hole 52 is sized to threadably receive a threaded opposing end 44 of the first cross rod 14. The second threaded hole 54 is sized to threadably receive a threaded opposing end 56 of the second cross rod 16.

Figure 6:
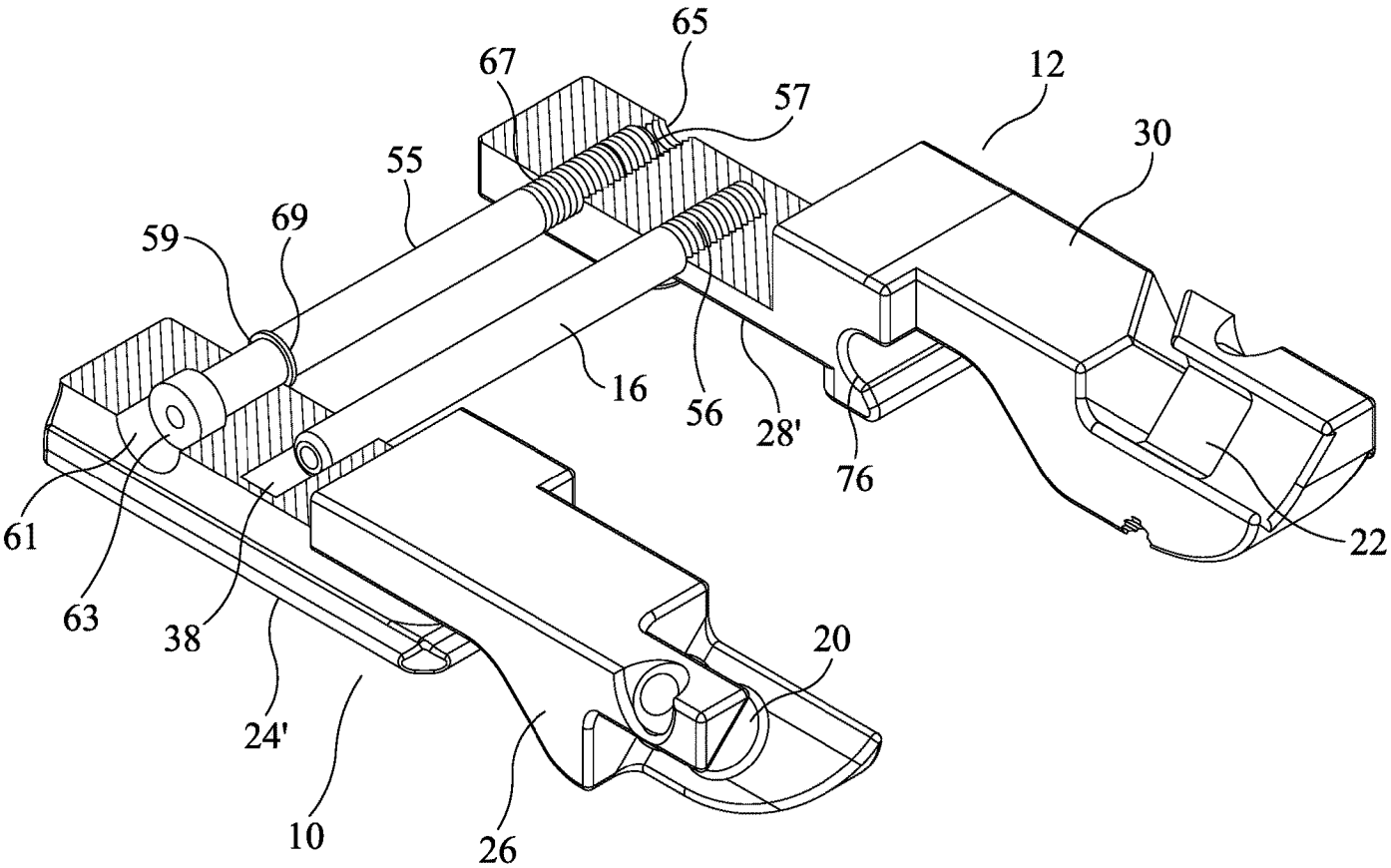
FIG. 6 is a perspective view of an adjustable width bowstring sled with a cut-away area, which reveals an alternative design of a first cross rod and a second cross rod in accordance with the present invention.

With reference to FIG. 6, an alterative design of the first cross rod includes a bolt 55; a set screw 57 or the like; and a snap ring 59. A counterbore 61 is formed in the first rod base 24' to receive a head 63 of the bolt 55. A threaded hole 65 is formed through the second rod base 28' to receive a threaded end 67 of the bolt 55. A snap ring groove 69 is formed in the bolt 55 to receive the snap ring 59. The snap ring 59 prevents axial movement of the bolt 55 relative to the first rod base 24'. The set screw 57 is used to jam the threaded end 67 of the bolt 55 to prevent rotation thereof.

The first line yoke 26 includes a pair of first retention projections 56, 58. The first roller slot 40 is formed between the pair of first retention projections 56, 58. The first roller slot 40 is sized to receive the first roller 20. The first roller 20 is preferably rotatably retained with a first shoulder screw 60 or any other suitable fastener. A first counter bore 62 is formed through one of the pair of retention projection 56, 58 and a first threaded hole (not shown) is formed through the other one of the pair of first retention projections 56, 58 to retain the first shoulder screw 60. The second line yoke 30 includes a pair of second retention projections 64, 66. A second roller slot 55 is formed between the pair of second retention projections 64, 66. The second roller slot 55 is sized to receive the second roller 22. The second roller 22 is preferably rotatably retained with a second shoulder screw 68. A second counter bore 70 is formed through one of the pair of second retention projections 64, 66, and a second threaded hole (not shown) is formed through the other one of the pair of second retention projections 64, 66 to retain the first shoulder screw 68. Alternatively, first and second shoulder screws 60, 68 may be replaced with first and second pins.

With reference to FIG. 2, a winding ribbon 72 is retained by the first and second rollers 20, 22. The winding ribbon 72 is retained on a pair of reels (not shown). A first string groove 74 is formed on an outside surface and a front surface of the first rod base 24. A second string groove 76 is formed on an outside surface and a front surface of the second rod base 28. The first and second grooves 74, 76 are sized to receive a bowstring 78.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An adjustable width bowstring sled comprising:

a first frame member;

a second frame member;

a first cross rod having one end rotatably retained in said first frame member, an opposing end of said first cross rod is threadably engaged with said second frame member, wherein rotation of said first cross rod changes a distance between said first and second frame members;

a second cross rod having one end slidably engaged with said first frame member, an opposing end of said second cross rod is retained in said second frame member;

a first roller is rotatably retained in said first frame member; and a second roller is rotatably retained in said second frame member.

2. The adjustable width bowstring sled of claim 1, further comprising:

a thumb wheel is attached to one end of said first cross rod.

3. The adjustable width bowstring sled of claim 2, further comprising:

said thumb wheel includes a plurality of width holes formed in one side thereof, a detent device is retained in said first frame member to engage one of said plurality width holes.

4. The adjustable width bowstring sled of claim 3 wherein:

a thumb wheel slot is formed in said first frame member to receive said thumb wheel.

5. The adjustable width bowstring sled of claim 1, further comprising:

said first cross rod includes a bolt, a snap ring and a threaded fastener, the bolt is rotatably retained in said first frame member with said snap ring, said threaded fastener is jammed against a threaded end of said bolt to prevent rotation of said bolt.

6. An adjustable width bowstring sled comprising:

a first frame member includes a front and a rear, a first roller slot is formed in a front of said first frame member, a first string groove is formed in an outside surface of said first frame member;

a second frame member includes a front and a rear, a second roller slot is formed behind a front of said second frame member, a second string groove is formed in an outside surface of said second frame member;

a first cross rod having one end rotatably retained in said first frame member, an opposing end of said first cross rod is threadably engaged with said second frame member, wherein rotation of said first cross rod changes a distance between said first and second frame members;

a second cross rod having one end slidably engaged with said first frame member, an opposing end of said second cross rod is retained in said second frame member;

a first roller is rotatably retained in said first roller slot; and a second roller is rotatably retained in said second roller slot.

7. The adjustable width bowstring sled of claim 6, further comprising:

a thumb wheel is attached to one end of said first cross rod.

8. The adjustable width bowstring sled of claim 7, further comprising:

said thumb wheel includes a plurality of width holes formed in one side thereof, a detent device is retained in said first frame member to engage one of said plurality width holes.

9. The adjustable width bowstring sled of claim 8 wherein:

a thumb wheel slot is formed in said first frame member to receive said thumb wheel.

10. The adjustable width bowstring sled of claim 6, further comprising:

said first cross rod includes a bolt, a snap ring and a threaded fastener, the bolt is rotatably retained in said first frame member with said snap ring, said threaded fastener is jammed against a threaded end of said bolt to prevent rotation of said bolt.

11. An adjustable width bowstring sled comprising:

a first frame member includes a first rod base and a first line yoke that extends from a front of said first rod base, a first string groove is formed in an outside surface and a front surface of said first rod base;

a second frame member includes a second rod base and a second line yoke that extends from a front of said first rod base, a second string groove is formed in an outside surface and a front surface of said second rod base;

a first cross rod having one end rotatably retained in said first rod base, an opposing end of said first cross rod is threadably engaged with said second rod base, wherein rotation of said first cross rod changes a distance between said first and second frame members;

a second cross rod having one end slidably engaged with said first rod base, an opposing end of said second cross rod is retained in said second rod base;

a first roller is rotatably retained in said first line yoke; and a second roller is rotatably retained in said second line yoke.

12. The adjustable width bowstring sled of claim 11, further comprising:

a thumb wheel is attached to one end of said first cross rod.

13. The adjustable width bowstring sled of claim 12, further comprising:

said thumb wheel includes a plurality of width holes formed in one side thereof, a detent device is retained in said first rod base to engage one of said plurality width holes.

14. The adjustable width bowstring sled of claim 13 wherein:

a thumb wheel slot is formed in said first rod base to receive said thumb wheel.

15. The adjustable width bowstring sled of claim 11, further comprising:

said first cross rod includes a bolt, a snap ring and a threaded fastener, the bolt is rotatably retained in said first rod base with said snap ring, said threaded fastener is jammed against a threaded end of said bolt to prevent rotation of said bolt.

* * * * *